US005240315A

United States Patent [19]

Roberts et al.

[11] Patent Number: 5,240,315

[45] Date of Patent: Aug. 31, 1993

[54] SEWING MACHINE CABINET WITH MANUAL LIFT

[75] Inventors: Fredrick D. Roberts, American Fork; E. Clark Roberts, Lindon; Merrill K. Roberts, American Fork, all of Utah

[73] Assignee: Roberts Mfg., Inc., American Fork, Utah

[21] Appl. No.: 848,105

[22] Filed: Mar. 9, 1992

[51] Int. Cl.[5] ..... A47B 81/00

[52] U.S. Cl. ..... 312/27; 248/669; 112/260

[58] Field of Search ..... 312/27, 30, 24, 26, 312/208.5; 248/669; 108/69, 71, 76; 206/320; 112/260, 217.1

[56] References Cited

U.S. PATENT DOCUMENTS 2,549,431 4/1951 Crosa et al. ..... 312/208.5
3,468,589 9/1969 Maynard ..... 112/217.1

FOREIGN PATENT DOCUMENTS 389029 1/1924 Fed. Rep. of Germany ..... 312/24
24879 9/1951 Finland ..... 312/24
662401 10/1949 United Kingdom ..... 108/76

*Primary Examiner*—Kenneth J. Dorner
*Assistant Examiner*—Janet M. Long
*Attorney, Agent, or Firm*—James L. Sonntag

[57] ABSTRACT

A sewing machine cabinet for mounting a sewing machine and for housing and storing the machine when not being worked, which provides a drop platform interiorly of the cabinet below the top working surface thereof for lowering the machine into the interior of the cabinet maintaining the sewing machine in an upright position not tilting. The cabinet is well adapted to open-arm sewing machines. A hinged top cover when opened lifts the sewing machine up out of the interior of the cabinet by leverage action on a pivoting link attached to a guided sliding support arm which is attached to drop platform which supports the sewing machine and is guided by a rack. The rack is provided by one or a pair of guide columns. The hinged top cover when opened 180° acts as a brake and lock for the moving drop shelf.

8 Claims, 3 Drawing Sheets

SEWING MACHINE CABINET WITH MANUAL LIFT

FIELD OF THE INVENTION

The invention is concerned with sewing machine cabinets having manual lifts for raising and lowering the sewing machines relative to work tables of cabinets.

BACKGROUND OF THE INVENTION

Many developments have been made in the past in sewing machine work tables and cabinets whereby a sewing machine can be effectively raised from a low storage position below a work table to a normal sewing position with respect to such work table. Most of these are manually operable, as typified by U.S. Pat. Nos. 2,738,248; Re. 28,835; and 4,135,463 to O. Berker, Kent S. Roberts et al. and Regean Lacasse, respectively. Other power lifts have achieved commercial success, typified by U.S. Pat. No. 3,993,008 to Joe T. Parsons, Sr. and 4,717,212 to Kent S. Roberts, both of which use a supporting platform for the sewing machine, which is mounted for up and down movement on two cylindrical columns which serve as guides for the shelf in its up and down movement powered by a motor using various means to cause the up and down movement. Moreover, most of the sewing machine cabinets known prior to the present invention have been complicated, unwieldy to use, and relatively expensive to produce.

SUMMARY OF THE INVENTION

An embodiment of the invention is an improvement in a sewing machine cabinet comprising;

(a) top wall and a vertical back wall defining a storage area beneath the top wall, the storage area adapted for receiving and storing a sewing machine, the top wall providing a top work surface for the cabinet, (b) a hinged top cover rotatably attached to said top wall along a horizontal hinge axis such that it can be moved between a horizontal closed position covering at least a portion of the top wall and a horizontal open position that extends the top work surface by rotating 180° about the axis;

(c) a sewing machine-receiving platform adapted to receive a sewing machine, (d) a lift assembly for moving the platform between a lowered storage position within the cabinet and a upper work position such that at least a portion of a sewing machine on the platform is extending through an aperture in the top wall, the lift assembly comprising at least one vertical guide column secured to the cabinet and a carriage means movable along the guide column, the platform mounted on the carriage means such that the lift assembly is adapted to support and maintain a sewing machine on the platform in an upright position and to move the platform along a vertical axis between the work position and the storage position, the improvement comprising;

(a) a compass link with a first end pivotally connected to the hinged top cover, (b) a sliding member adapted to slide along a horizontal axis, with a second end of the compass link pivotally connected to the sliding member such that when the hinged cover is opened and closed the sliding member is moved along the horizontal axis, (c) a cable with a first end attached to the sliding member and the second end attached to the platform, the cable being directed horizontally, over a grooved wheel, and then downward to the second end, such that horizontal movement of the sliding member along the horizontal axis caused by opening and closing of the top cover moves the platform between the work position and the storage position.

The sliding member may be any suitable means for transferring the movement of the second end of the compass link to horizontal motion, such as a sliding block along guides, or preferably a u-channel inverted over a horizontal guide rail, as described more fully below.

Another embodiment of the invention is an improvement in a sewing machine cabinet comprising walls defining a housing or storage area for receiving and storing a sewing machine, the walls including an apertured top wall providing a top work surface for the cabinet. On the top wall is a top cover attached by hinges to the top wall such that when opened 180° extends and expands the top work surface into a sewing machine-platform. A sewing machine normally rests on said which platform is adapted to receive and support a sewing machine. A manual lift assembly is provided for raising the platform from a lowered storage position within the cabinet to a work position, wherein the manual lift assembly comprises one or a pair of guide columns secured to the cabinet and a carriage mounting the platform of sufficient strength to support and maintain a sewing machine in an upright position, not tilting. The improvement of the invention involves the manual lift platform and the means by which it is moved to and from a storage position by the hinged top cover that acts as a power-input arm and lever when moved from one horizontal position to a vertical and then opposite horizontal position, the hinge serving as the fulcrum. The interacting parts that effect this movement include a compass link pivotally connected to the hinged top cover. The compass link is also pivotally connected to a horizontal sliding u-channel arm which is attached to a cable. The cable moves from a horizontal plane over a grooved wheel to a vertical plane connected to an adjustable eye bolt, and said bolt is bolted to the sewing machine-receiving platform. The hinged top cover also acts as a brake when lowering said sewing machine-receiving platform into the interior of the cabinet and as a lock when the sewing machine-receiving platform reaches its highest point and stops.

The present invention is an improvement in a manual lift sewing machine cabinet. It is highly desirable that the sewing machine be lifted from and lowered back to its storage position within the cabinet rapidly and without stoppages by reason of binding of working components. It is also desirable that the working mechanism be not only reliable in operation, but also be simple and easy to operate and capable of being manufactured at low cost.

An object of the invention is to attain all of these desirable characteristics in a sewing machine cabinet with a manual lift. One or a pair of guide columns for the sewing machine-receiving platform serves as a rack to guide the platform for raising and lowering such sewing machine relative to the platform. The top wall of the cabinet is apertured sufficiently to provide an accommodation opening providing leeway for raising and lowering the machine. Above the top wall and resting on said top wall is a hinged cover, better known in the industry as a hinged leaf, that when opened 180° not only extends and expands the work surface area, but also acts as a lever to raise and lower the sewing machine by means of a compass link pivotally connected to said leaf, and is pivotally connected to a sliding channel arm which said channel not only supports the leaf to maintain a horizontal plane, but also is connected to a cable. Said cable is guided horizontally over a grooved wheel and connected vertically to an eye bolt. Said eye bolt is adjustable for varying height sewing machines and is connected to a drop platform whereon sets the sewing machine.

We have found that this arrangement is economical, operationally effective, very rapid in response, and trouble-free in relation to the heavy sewing machine that it must handle.

DETAILED DESCRIPTION OF THE INVENTION

Figure 1:
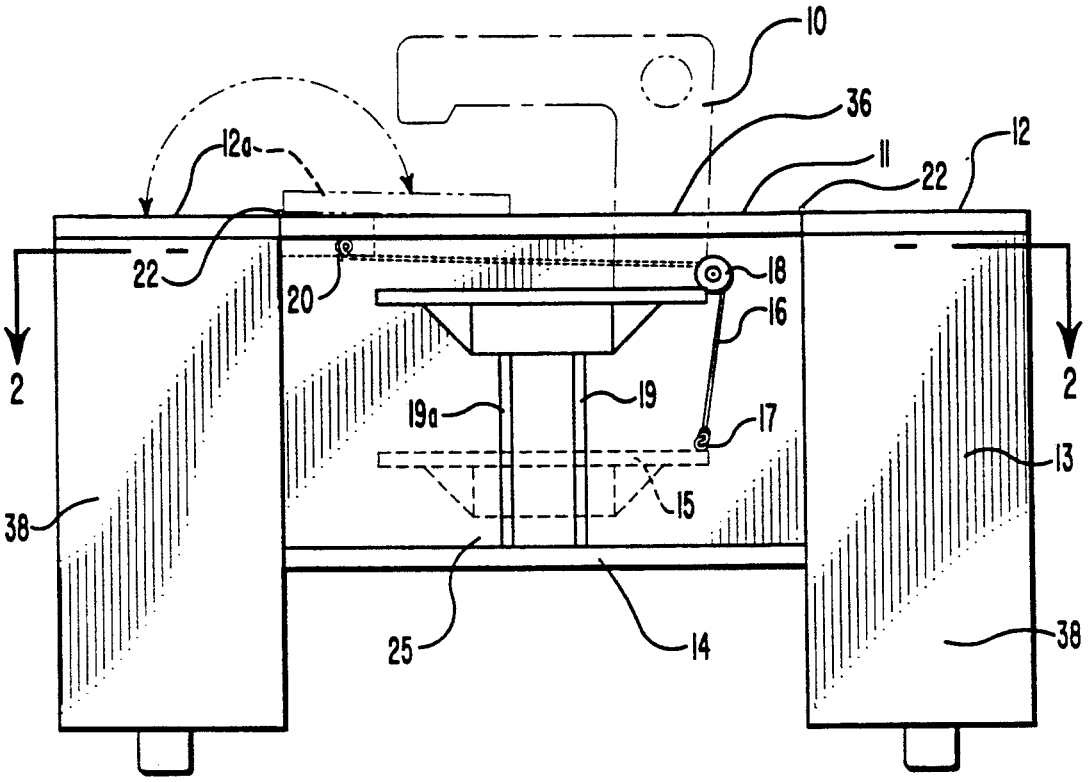
FIG. 1 is a front elevational view of a typical sewing machine cabinet equipped with manual lift in accordance with the invention, showing the sewing-machine-receiving platform and associated mechanism in a work position, with both the sewing machine and the lowered storage position of the platform hinged leaf and associated mechanism being indicated by broken lines.
Figure 2:
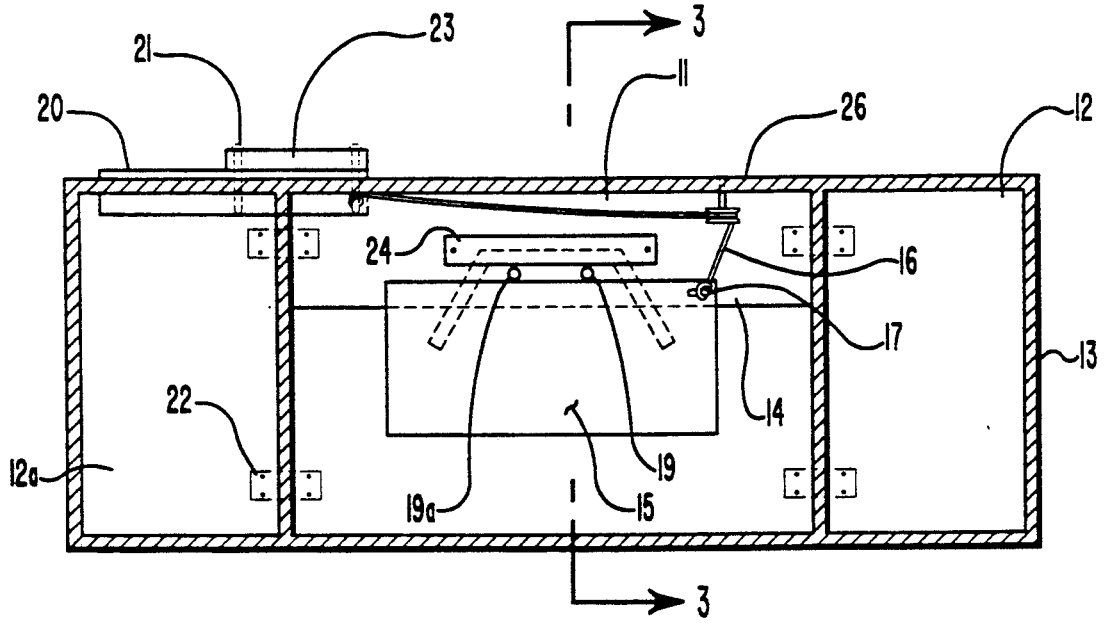
FIG. 2, a view in horizontal section taken on the line 2—2 of FIG. 1.
Figure 3:
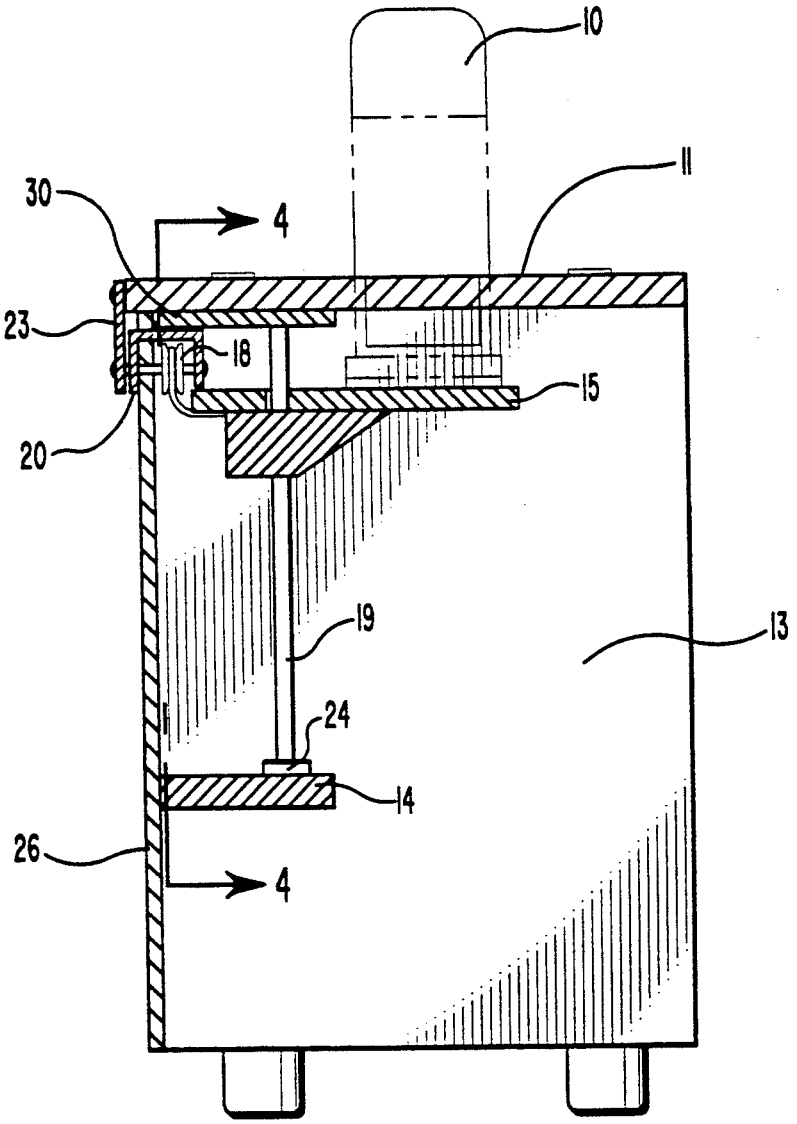
FIG. 3, a side elevational view partly in trans vertical section taken on the line 3—3 of FIG. 2.
Figure 4:
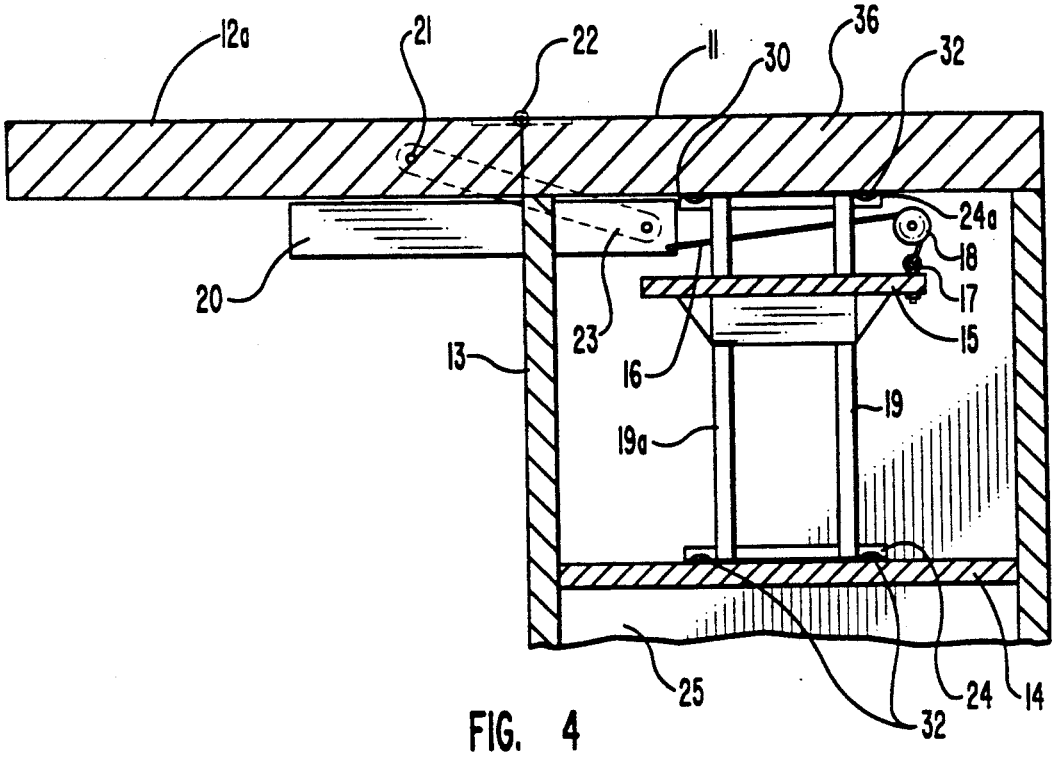
FIG. 4 is a front elevation view of only a portion of a cabinet taken along line 4—4 of FIG. 3 for illustration purposes with the top cover in open position.
Figure 5:
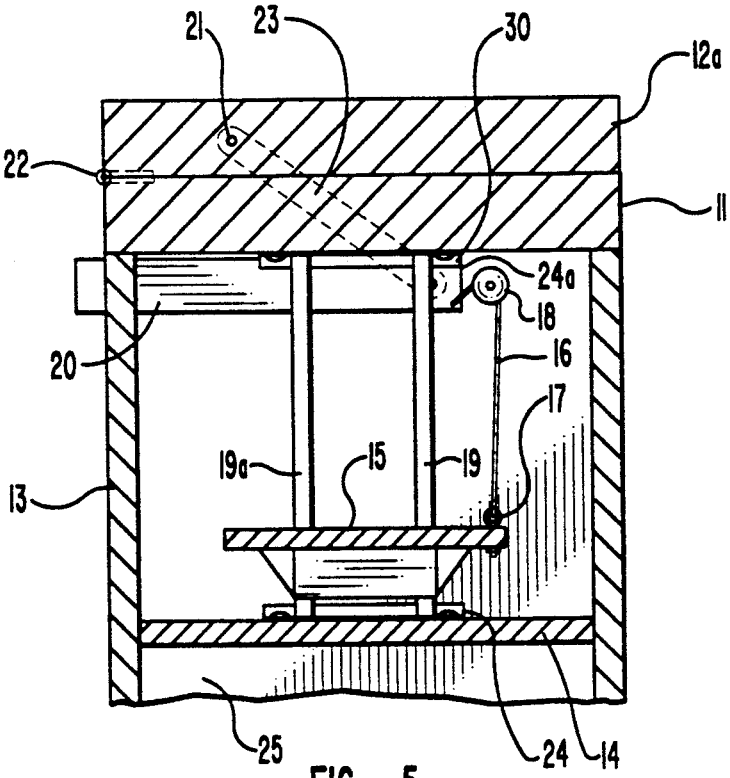
FIG. 5 is a view corresponding to that of FIG. 4, but with the top cover in closed position.

In its illustrated form, the invention comprises a sewing machine cabinet 13 of known construction typical of commercial cabinets made to both store a sewing machine 10 and to place it into a working position relative to the upper working surface 11 of a work table 12, such position being well known to those familiar with this art. Work table 12 has an elongated platform-accommodating aperture 36 at some convenient location therein, for example as illustrated in FIG. 1 and 3 and a correspondingly elongated sewing machine-receiving platform and manual lift assembly are mounted within cabinet 13 below such aperture. The assembly comprises a platform 15 of size adapted to receive an elongated sewing machine, such as 10, to be stored within a central compartment 25 of cabinet positioned between opposite end compartments 38 which may be provided with drawers (not shown) in the usual manner. As shown, central compartment 25 is open at the front so the open front will accommodate the knees of one using the sewing machine when platform 15 is raised. A bottom panel 14 extends a short distance forward from rear panel 26 of the cabinet for supporting the platform and manual lift assembly. The manual lift comprises mounting means in the form of a pair of elongated structural plate members 24 and **24*a* secured by screws 32, as shown in FIGS. 4 and 5, to the underside of work table 12 as a top member and the upper face of bottom panel 14 as a bottom member, respectively. To and between these two members, are fixedly secured a pair of guide columns 19 and 19*a* which provide a path of up and down travel for platform 15**.

As shown in FIGS. 1 and 3, platform 15 is stopped, well below a position flush with the work surface 11 of the cabinet. Ordinarily, a sewing machine platform will be stopped flush with the working surface of the cabinet for usual sewing tasks. However, sewing machine platform heights vary from brand to brand, therefore to accommodate the varying heights, eye bolt 17 adjusts platform 15 stop height allowing the sewing machine platform to stop flush with the cabinet work surface 11.

As shown in FIGS. 4 and 5, hinged top cover **12*a* which is attached to the working surface 11 by hinges 22, when opened manually 180° acts as a power arm and lever to raise sewing machine 10 by compass link 23 pivotally connected by ordinary means, such as pin 21 to said cover 12*a*. Said link 23 is also pivotally connected to horizontal sliding u-channel arm 20 connected to cable 16. The u-channel 20 is inverted over a guide rail 30 defined by a portion of the top edge of the back wall 26 of the cabinet. The u-channel 20 is guided horizontally by the guide rail 30 defined by cabinet back wall 26 and said cable 16 is guided horizontally over grooved wheel or pulley 18. Said cable 16 moves to a vertical plane connected to adjustable eye bolt 17. Said eye bolt is bolted to platform 15 assuring its upward and downward movement. U-channel arm 20 is of sufficient length to desirably support cover 12 maintaining a horizontal plane. Said hinged cover 12*a* expands the sewing surface area, acts as lever, and also as a brake and lock for platform 15 in the up and down positions as demonstrated in FIGS. 1 and 4**.

Wherein this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims.

What is claimed is:

1. In a sewing machine cabinet comprising;

(a) a top wall and a vertical back wall defining a storage area beneath the top wall, the storage area adapted for receiving and storing a sewing machine, the top wall providing a top work surface for the cabinet, (b) a hinged top cover rotatably attached to said top wall along a horizontal hinge axis such that it can be moved between a horizontal closed position covering at least a portion of the top wall and a horizontal open position that extends the top work surface by rotating 180° about the axis;

(c) a sewing machine-receiving platform adapted to receive a sewing machine, (d) a lift assembly for moving the platform between a lowered storage position within the cabinet and a upper work position such that at least a portion of a sewing machine on the platform is extending through an aperture in the top wall, the lift assembly comprising at least one vertical guide column secured to the cabinet and a carriage means movable along the guide column, the platform mounted on the carriage means such that the lift assembly is adapted to support and maintain a sewing machine on the platform in an upright position and to move the platform along a vertical axis between the work position and the storage position, the improvement comprising;

(a) a compass link with a first end pivotally connected to the hinged top cover, (b) a sliding member adapted to slide along a horizontal axis, with a second end of the compass link pivotally connected to the sliding member such that when the hinged cover is opened and closed the sliding member is moved along the horizontal axis, (c) a cable with a first end attached to the member sliding and the second end attached to the platform, the cable being directed horizontally, over a grooved wheel, and then downward to the second end, such that horizontal movement of the sliding member along the horizontal axis caused by opening and closing of the top cover moves the platform between the work position and the storage position.

2. The improvement of claim 1 wherein the sliding member comprises a u-channel inverted over a horizontally disposed guide rail such that the u-channel slides horizontally along guide rail.

3. The improvement of claim 2 wherein the compass link is pivotally connected to the top cover on the back side edge close in proximity to the hinge axis so as to give maximum leverage to the top cover which acts a power arm and lever when moved between the closed position and the open position.

4. The improvement of claim 3, wherein said compass link links the top cover power arm lever pivotally to the sliding u-channel arm on the outside opposite the interior of the cabinet.

5. The improvement of claim 4, wherein said u-channel supports said hinged top cover when the top cover is open, and wherein the guide rail of the u-channel is a portion of the top edge of the back wall, and wherein said u-channel is attached to the first end of the cable on the interior of the cabinet, and wherein the u-channel is metal bent to formation.

6. The improvement of claim 5 wherein said cable is guided horizontally by said u-channel over the grooved wheel and the grooved wheel is secured to the back wall of the cabinet, and the second end of the cable is connected to the platform by means of an adjustable eye bolt.

7. The improvement of claim 6, wherein said adjustable eye bolt is bolted to said sewing machine-receiving platform in the interior of the cabinet, and wherein said eye bolt is of sufficient length to adjust said platform to compensate for the maximum and minimum heights of different sewing machines.

8. The improvement of claim 7 wherein said eye bolt is located on the platform such that the platform is balance by force induced on the platform by the cable sufficient to prevent binding during the upward and downward movement of the platform.

* * * * *